US006643478B2

(12) United States Patent
Okano

(10) Patent No.: US 6,643,478 B2
(45) Date of Patent: Nov. 4, 2003

(54) FIXING DEVICE AND TEMPERATURE CONTROL METHOD IN FIXING DEVICE

(75) Inventor: Yoshiaki Okano, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/993,769

(22) Filed: Nov. 27, 2001

(65) Prior Publication Data

US 2003/0099478 A1 May 29, 2003

(51) Int. Cl.[7] ..... G03G 15/20
(52) U.S. Cl. ..... 399/70
(58) Field of Search ..... 399/69, 70, 328, 399/329, 330; 219/216

(56) References Cited

U.S. PATENT DOCUMENTS

| | | | | | |
|---|---|---|---|---|---|
| 5,790,919 A | * | 8/1998 | Lee | ..... | 399/43 |
| 6,055,390 A | * | 4/2000 | Kurotaka et al. | ..... | 399/69 |
| 6,351,619 B1 | * | 2/2002 | Yamada | ..... | 399/70 |
| 6,353,719 B1 | * | 3/2002 | Lee | ..... | 399/69 |

FOREIGN PATENT DOCUMENTS

| | | | | | |
|---|---|---|---|---|---|
| JP | 02222982 A | * | 9/1990 | ..... | G03G/15/20 |
| JP | 05127566 A | * | 5/1993 | ..... | G03G/15/20 |
| JP | 07013459 A | * | 1/1995 | ..... | G03G/15/20 |
| JP | 08036324 A | * | 2/1996 | ..... | G03G/15/20 |
| JP | 11045030 A | * | 2/1999 | ..... | G03G/15/20 |
| JP | 11-311914 | | 11/1999 | | |
| JP | 2001-142350 | | 5/2001 | | |

* cited by examiner

*Primary Examiner*—Robert Beatty
(74) *Attorney, Agent, or Firm*—Foley & Lardner

(57) ABSTRACT

A fixing device of the present invention has a fixing belt that is brought in contact with a recording medium to heat and fix a developer image formed on the recording medium. Plural supporting rollers support the fixing belt rotatably. Pressing rollers are provided opposing to the supporting rollers via the fixing belt for clamping and conveying the recording medium jointly with the fixing belt. A temperature controller raises the temperature of a heating roller to a second set temperature from a first set temperature after the temperature of the fixing belt drops to a prescribed temperature lower than that in the heating and fixing state, when shifting to the ready state after the heating and fixing state is complete.

12 Claims, 10 Drawing Sheets

HEAT ROLLER TEMPERATURE Th IN READY STATE

BELT TEMPERATURE IN READY STATE Tb

| | 165°C | 175°C | 185°C |
|---|---|---|---|
| 155°C | O | × | × |
| 135°C | O | O | × |
| 115°C | O | O | O |
| 95°C | | O | O |

FIG.5

FIXING DEVICE AND TEMPERATURE CONTROL METHOD IN FIXING DEVICE

BACKGROUND OF THE INVENTION

1. Field of the Invention

The present invention relates to a fixing device for heating, pressurizing and fixing a developer image on recording media using fixing belt heated by a heating roller.

2. Description of the Related Art

In recent years, out of fixing devices that are used in electro-photographic type copiers and printers for heating and pressure fixing toner images formed on a sheet of paper, a belt type fixing device has been developed. This fixing device is excellent in keeping an uniform fixing temperature and capable of obtaining a good fixing even for an image with toners superposed like a full-color image.

This belt type fixing device has an endless belt type fixing belt that is put over between a fixing roller and a heating roller and heated by a heating roller. A pressing roller is brought in contact with the fixing belt supported by the fixing roller and presses the belt, and a sheet of paper is forced to pass through a nip formed between the fixing belt and the pressing roller. A toner image formed on a sheet paper is heated and press fixed.

In such a belt type fixing device, when the heating roller (or the fixing belt on the heating roller) was controlled at the same temperature in the ready state and in the fixing operation, the fixing belt was not heated sufficiently when the next fixing operation was started and the defective fixing was caused by the low temperature offset phenomenon. This defective fixing is generated by a temperature drop for heat radiation of the fixing belt at the part not in contact with the heating roller. On the other hand, when the fixing is performed after the fixing belt is heated to a prescribed temperature when starting the fixing operation as a countermeasure to prevent this low temperature offset phenomenon, there will be generated such a problem that a first copy time becomes long.

In order to solve such a problem, an apparatus to set the heating roller temperature in the ready state (or the fixing belt temperature on the heating roller) at a higher temperature than the heating roller temperature in the fixing operation has been developed. Thus, by setting the temperature of the heating roller, the temperature rise of the fixing belt at the time of starting the fixing was made fast and the first copy time was prevented from becoming long and generation of the low temperature offset phenomenon was also prevented.

However, when the heating roller was so controlled that its set temperature became higher in the ready state than that in the fixing operation as in a conventional apparatus, if the next fixing operation was started immediately after shifting to the ready state when completing the fixing operation, the temperature of the fixing belt at the time when starting the next fixing operation became to higher than a prescribed fixing temperature, the high temperature offset phenomenon was generated and the fixing became defective. This problem was caused as the fixing belt was further heated at a higher temperature in the state wherein its temperature was not sufficiently dropped by the heat radiation.

Accordingly, in the belt type fixing device, even when the next fixing operation was started immediately after completing the current fixing operation, it is desirable to prevent the generation of the high temperature offset phenomenon resulting from the heating of the fixing belt to above a prescribed fixing temperature and obtain fixed images of high quality without badly affecting reduction of a first copy time.

SUMMARY OF THE INVENTION

An object of the present invention is to obtain fixed images in a belt type fixing device without impairing reduction of a first copy time by preventing generation of the high temperature offset phenomenon when making the next the fixing operation immediately after completing the current fixing operation.

According to the embodiment of the present invention, there is provided a fixing device comprising: an endless belt shaped first heating device for heating and fixing a developer image formed on the recording medium by contacting it; plural supporting members for supporting the first heating device rotatably; a pressing device provided opposing to the supporting members via the first heating device for conveying the recording medium by clamping it jointly with the first heating device; a second heating device for heating the first heating device by keeping a first set temperature during the heating and fixing of the developer image by the first heating device and keeping a second set temperature higher than the first set temperature during the ready state; and a temperature controller for raising the temperature of the second heating device to the second set temperature from the first set temperature after the first heating device drops to a prescribed temperature lower than that during the heating and fixing when the fixing device is shifted to the ready state from the heating and fixing state by the first heating device.

Further, according to the present invention, there is provided a fixing device comprising: a fixing belt for contacting a recording medium, heating and fixing a developer image formed thereon; plural supporting rollers for supporting the fixing belt rotatably; a pressing roller provided opposing to the supporting rollers for clamping and conveying the recording medium jointly with the fixing belt; a heating roller for heating the fixing belt by keeping the set temperature during the heating and fixing the developer image by the fixing belt and keeping the second set temperature higher than the first set temperature during the ready state; and a temperature controller for raising the temperature of the heating roller to the second set temperature from the first set temperature after the fixing belt drops to a prescribed temperature lower than that during the heating and fixing when the fixing belt is shifted from the heating and fixing state to the ready state.

Further, according to the present invention, there is provided a temperature control method comprising the steps of a first step for keeping the fixing belt at the first set temperature during the heating and pressure fixing of the developer image; a second step for raising the temperature of the heating roller to the second set temperature from the first set temperature after the fixing belt drops to a prescribed temperature lower than that during the heating and fixing after completing the heating and pressure fixing of the developer image; and a third step for keeping the fixing belt at the second set temperature during the ready state.

BRIEF DESCRIPTION OF THE DRAWINGS

FIG. 5 is a table showing fixing test results used for the temperature setting of the heating roller in the first embodiment of the present invention;

DETAILED DESCRIPTION OF THE INVENTION

Figure 1:
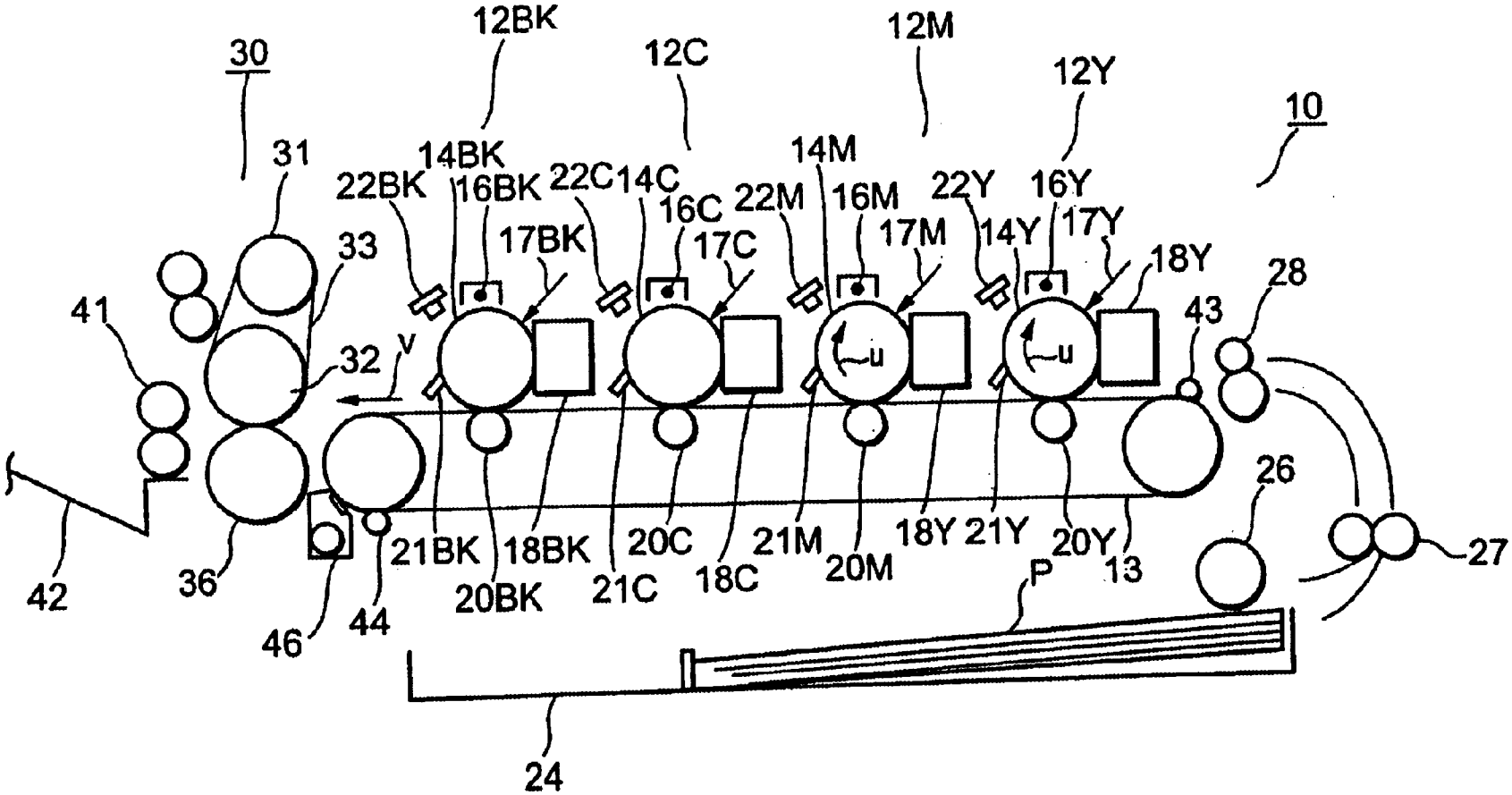
FIG. 1 is a schematic diagram showing an image-forming unit of an image-forming apparatus in a first embodiment of the present invention.
Figure 2:
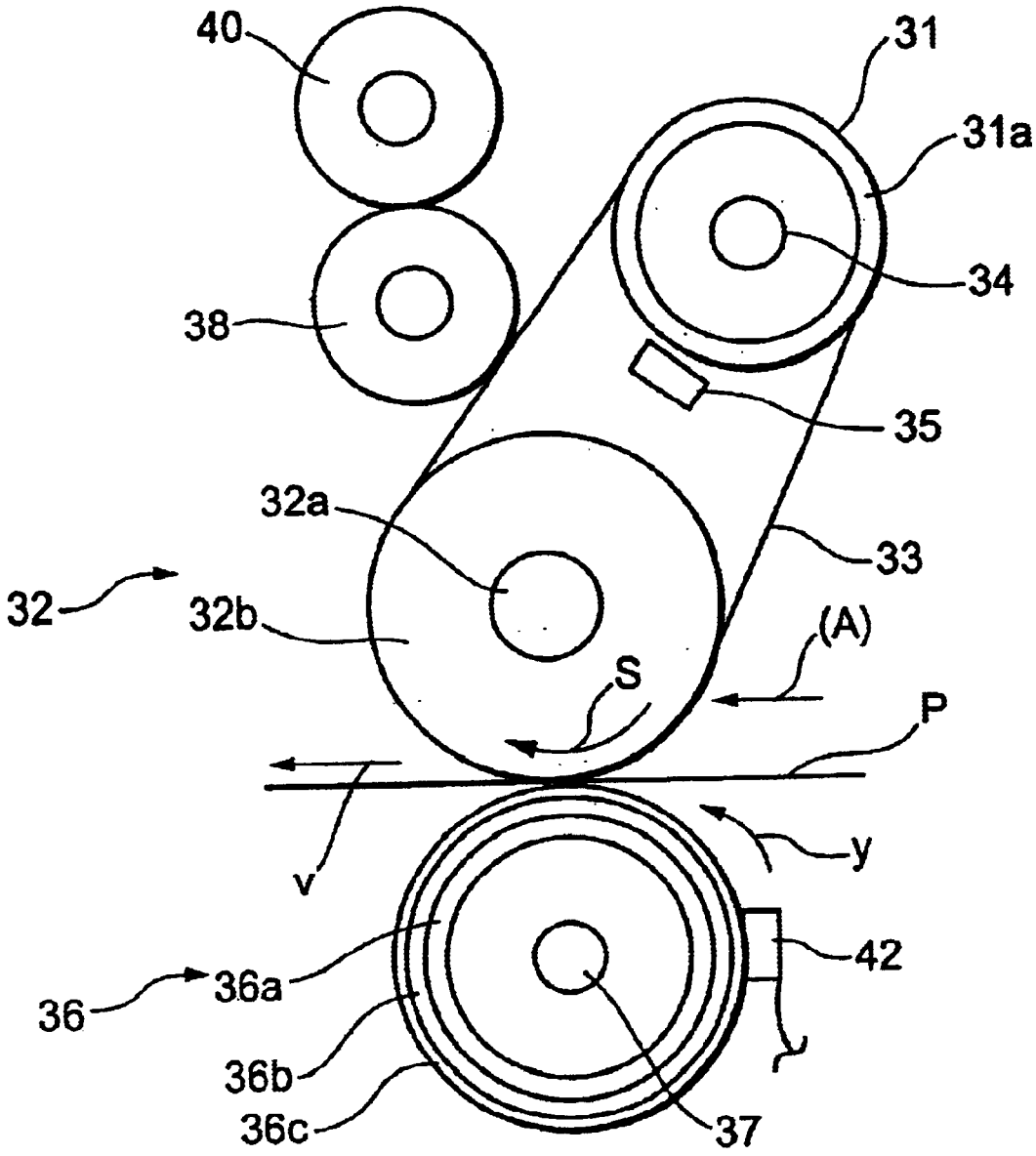
FIG. 2 is a schematic diagram showing a fixing device of in the first embodiment of the present invention.

Preferred embodiments of the present invention will be explained below in detail referring to attached drawings. First, the first embodiment of the present invention will be described. FIG. 1 is a schematic diagram showing an image-forming unit 10 of a four-tandem type full-color printer in a first embodiment of the present invention. In the image-forming unit 10, 4 sets of yellow (Y), magenta (M), cyan (C), and black (BK) stations 12Y, 12M, 12C and 12B, which form developer images of respective color components using yellow (Y), magenta (M), cyan (C), and black (BK) toners are arranged in parallel along a transferring conveyor belt 13 to convey sheet paper P that is a recording medium.

The color stations 12Y, 12M, 12C and 12BK are in the same construction and therefore, they are explained referring to the yellow station 12Y arranged at the former stage as a representative station, and by adding the same reference numerals to the same elements and subscripts showing respective colors, the explanations of other color stations 12M, 12C and 12Bk will be omitted.

The yellow station 12Y has a photo-conductive drum 14Y, and around it, a charger 16Y, an exposing device (not illustrated) for applying a yellow (Y) optical signal 17Y, a developing device 18Ym a transferring roller 20Y, a cleaner 21Y,and a charge eliminator 22Y are arranged in order along its rotary direction. The transferring roller 29Y is provided opposing to the photo-conductive drum 14Y through a transferring conveyor belt 13.

Further, under the stations 12Y, 12M, 12C and 12BK, there are provided a paper cassette device 24 for housing sheet paper P that is recording media, a pick-up roller 26 for taking out a sheet of paper P from the paper cassette device 24, a feed roller pair 27 for conveying the sheet of paper P taken out of the paper cassette device 24, and an aligning roller pair 28 for supplying the sheet of paper P at a proper timing. The conveying speed of the sheet of paper P by the aligning roller pair 28 and the transferring and conveying belt 13 is so set that it becomes equal to a peripheral speed of the photo-conductive drums 14Y, 14M, 14C and 14BK. Further, at the downstream side of the transfer and conveyor belt 13, a belt shaped fixing device 30 and a paper discharge roller pair 42 are arranged. Further, 43 is an adsorption roller for giving electric charge for adsorbing a sheet of paper P to the transferring conveyor belt 13, 44 is a transferring conveyor belt charge eliminating roller, and 46 is a transferring conveyor belt cleaner.

Next, the belt shaped fixing device 30 will be described in detail. A fixing belt 33 is put over a heating roller 31 that serves as a supporting member and a second heating device and a fixing roller that is a supporting member at a tension. The fixing belt 33 is composed of a base material made of a thin seamless belt formed by a metal such as nickel, etc. or heat resisting resin such as polyimide, etc. and the surface is covered by or coated with oil impregnated silicon rubber, heat resisting rubber such as fluoric rubber or fluoric resin. Or the fixing belt 33 is made of silicon rubber covered by or coated with heat resisting highly mold releasing resin like PFA (a copolymer of tetrafluoro-ethylene and parfluoro-vinyl-ether) tube.

Further, the fixing belt 33 of this embodiment is made of a thin seamless belt of elector-forming 36 $\mu$m nickel coated with a silicon rubber heat resisting elastic layer in 200 $\mu$m thick at the outer surface and further covered by a 30 $\mu$m thick PFA tube. Further, the outer surface of the fixing belt 33 is kept in contact with an oil coating roller 38 that coats the belt 33 with silicon oil in order to prevent toner offset to the fixing belt 33. Further, a cleaning roller 40 is provided to the outer surface of the oil coating roller 38 for removing toner, paper powder, etc. adhered thereto. An oil impregnated resistive paper in the outer diameter 22 mm is wound round the core metal of the oil coating roller 28 and furthermore, its outside is covered by a highly mold releasing porous fluoric resin tube core controlling oil coating. The cleaning roller 40 is in the outer diameter 21 mm and the aluminum (Al) made roller surface is coated by fluoric resin in 20 $\mu$m thick.

The heating roller 31 is made of a core metal 31*a* of a 3 mm thick aluminum (Al) pipe in diameter 30 mm coated by a coating layer of about 20 $\mu$m thick PTFE (polytetrafluoro-ethylene). In the hollow inside of the heating roller 31, a heater lamp 34 of 550W is provided as a heating source. Around the heating roller 31, a thermistor 35 that is a second temperature sensor to detect the surface temperature (Th) of the heating roller 31 in order to control a heater lamp 34. The thermistor 35 may be provided around the fixing belt 33 that is wound round the outer surface of the heating roller 31. The fixing roller 322 is in the outer diameter 38 mm with a hardness of 30° (ASKER-C Hardness) and the outer surface of a core metal 32*a* is covered by a heat resisting elastic body 32*b* made of a 8 mm thick silicon sponge. For the heat resisting elastic body 32*b*, a sponge made material is desirable from the viewpoint that thermal insulation is high and a nip can be secured at a low weight but a rubber made elastic body is also usable.

Further, at a position opposite to the fixing roller 32 via the fixing belt 33, there is a pressing roller 36 that is a pressing device to form a 7.5 mm nip with the fixing belt 33 by applying about 250N load between the fixing roller 32 by a spring (not illustrated) is kept in contact with the fixing roller 32. The pressing roller 36 is in the outer diameter 40 mm and with a hardness of 80° (ASKER-C Hardness) and the outer surface of a core metal 36*a* made of a 5 mm thick aluminum pipe is covered by a 1 mm thick silicon rubber (a silicon rubber of JIS-A Harness 20°) 36*b*. Its outer surface is further covered by a 30 $\mu$m thick PFA tube 36*c*. In the hollow inside of the pressing roller 36, a 450 W heater lamp 37 is provided. Around the pressing roller 36, there is provided a thermistor 42 that senses the surface temperature of the pressing roller 36 in order to control the heater lamp 37.

Figure 3:
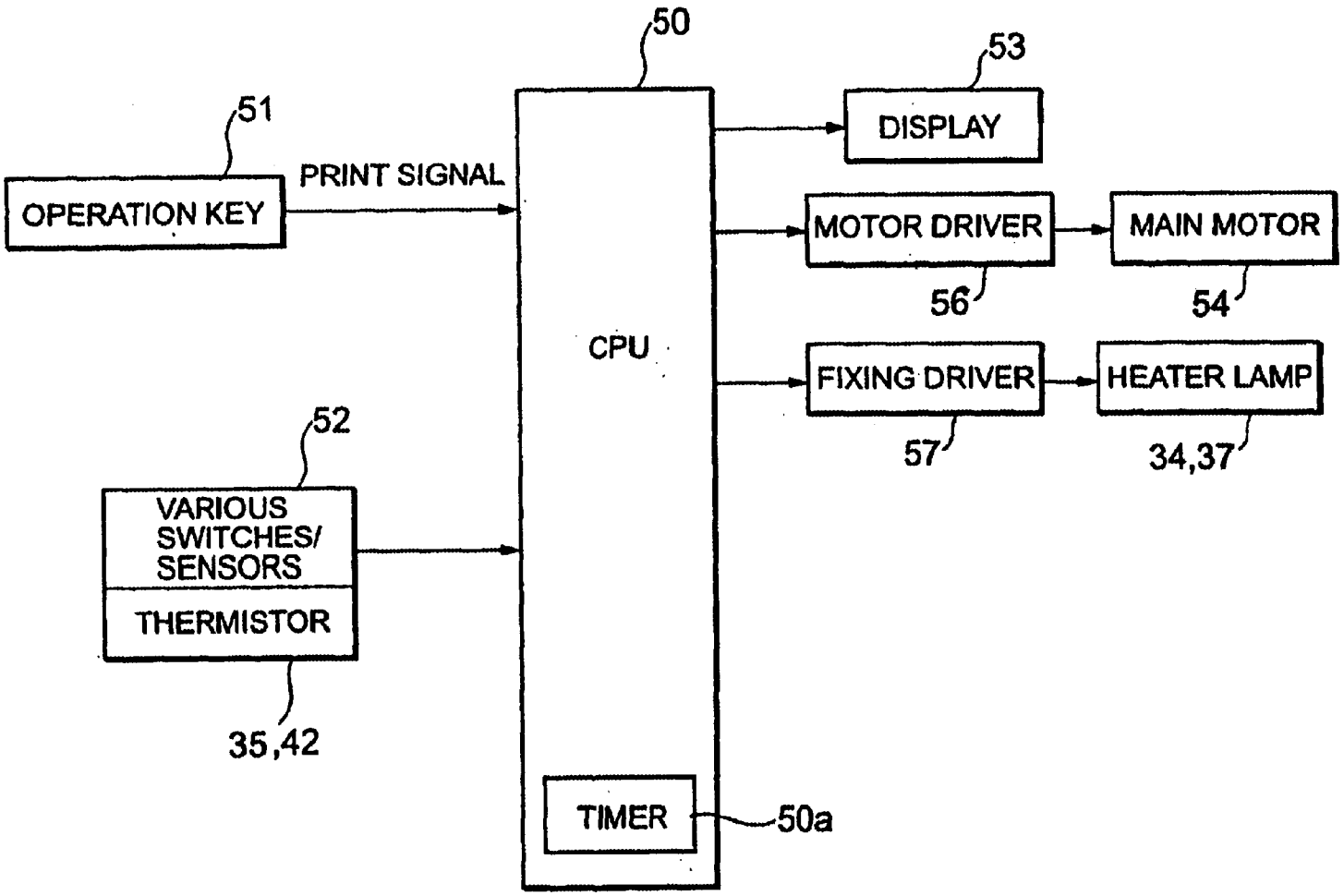
FIG. 3 is a block diagram showing essential elements of a controller in the first embodiment of the present invention.

The heater lamp 34 of the heating roller 31 and the heater lamp 37 of the pressing roller 36 are controlled by a CPU 50 that is a temperature controller shown in FIG. 3. The CPU 50 is also a controller of a full-color printer in this embodiment and has a built-in timer 50*a* and operation keys 51 on an operation panel (not illustrated) that is capable of inputting print mode, sheet paper selection, number of sheets, etc., various kinds of switches/sensors 52 including the thermistor 35, 42 are connected to its input side. At the output side of the CPU 50, a display 53 on the operation panel (not illustrated), a motor driver 56 that controls a main motor 54 to drive the heating roller 31 of the fixing device 30, and a fixing driver 57 that controls the heater lamp 34 according to the temperature sensing result from the thermistor 35 and counts of a timer 50*a* and controls the heater lamp 37 according to the temperature detection result from the thermistor 42 are connected.

Figure 4:
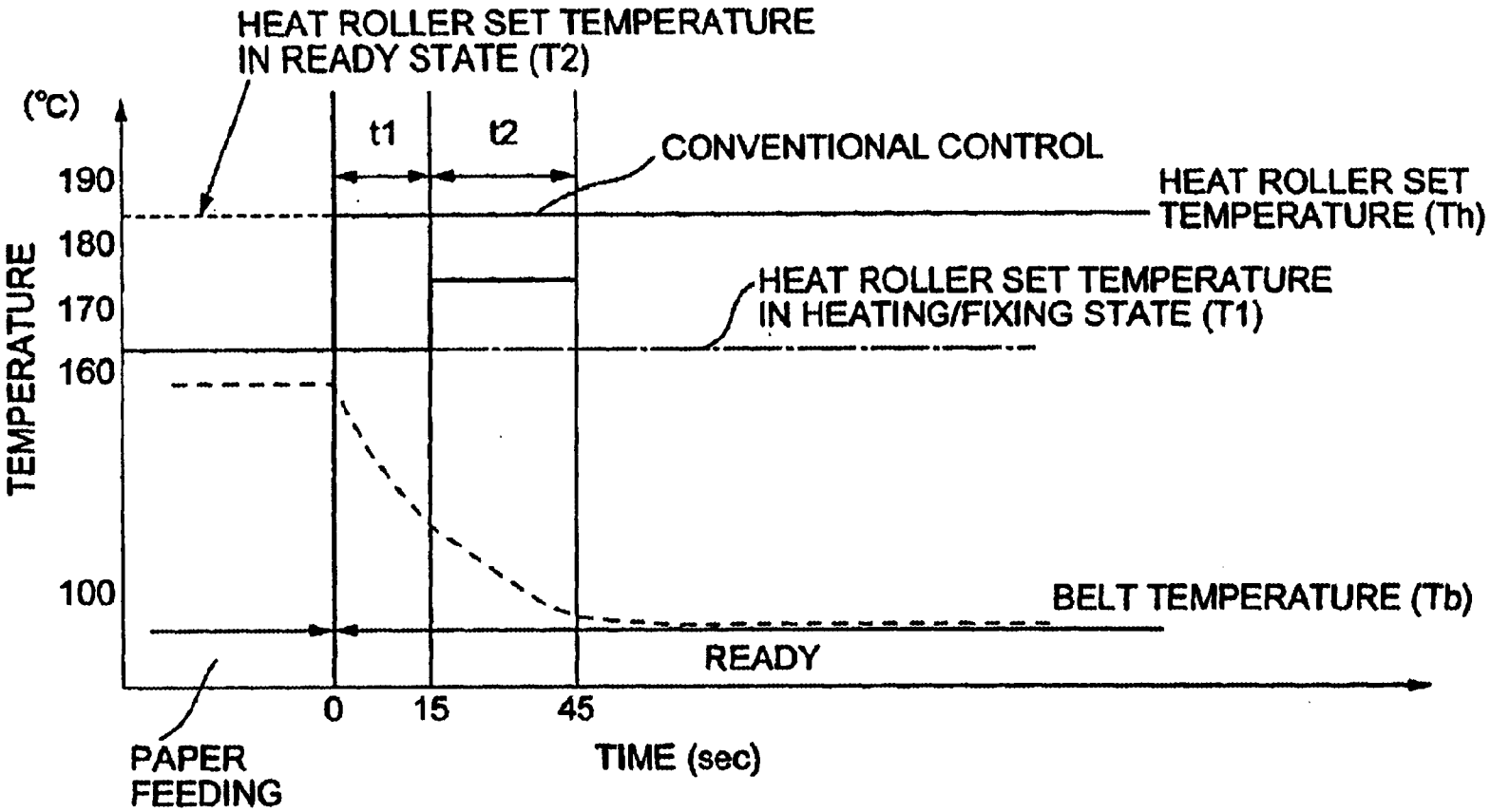
FIG. 4 is a graph showing the temperature control of a heating roller in the first embodiment of the present invention.

The fixing driver 57 controls the surface temperature (Th) of the heating roller 31 as shown in FIG. 4 by turning the heater lamp 34 ON/OFF. When the main motor 54 is stopped and the fixing belt 33 is stopped and in the ready state, the surface temperature (Th) of the heating roller 31 is held at the heating roller set temperature T2° C. in the ready state, that is a second set temperature (185° C. in this embodiment). When the printing by a full-color printer is in process and the fixing device 30 is heating and fixing, the surface temperature (Th) of the heating roller 31 is held at the heating roller set temperature 1° C. during the paper feeding that is lower than the second set temperature (165° C. in his embodiment).

When the count of the timer 50*a* elapsed t1 second (15 seconds in this embodiment) after the print is completed and the trailing edge of sheet paper P passed the fixing device 30, the surface temperature (Th) of the heating roller 31 is set at the heating roller set temperature T1+10° C. (175° C. in this embodiment) during the paper feeding. Further, when the count of the timer 50*a* elapsed t2 seconds (30 seconds in this embodiment), the surface temperature (Th) of the heating roller is raised to the heating roller set temperature T2° C. (185° C. in this embodiment)in the ready state. Further, the temperatures on the belt shown in FIG. 4 are the temperatures of the fixing belt 33 measured at the arrow mark position A.

When the set temperature of the heating roller 31 is shifted to the ready set temperature after completing the fixing, the temperature of the heating roller is raised several times based on the fixing result obtained from the fixing test by a full-color printer in this embodiment shown below. In this fixing test, while the heating roller set temperature T1° C. during the heating and fixing was set at 165° C., the heating roller set temperature T2° C. in the ready state was varied to 185° C., 175° C. and 165° C. and the fixing operation was started at the temperatures of the fixing belt 33 of 155° C., 135° C., 115° C. and 95° C., respectively and the fixing state was observed.

As a result, when the heating roller set temperature T2° C. in the ready state was held at 185° C. as shown in FIG. 5, it was revealed that it was immediately after shifted to the ready state and when the fixing was started at the temperature of the fixing belt 33 as high as 155° C. or 135° C. and a bad fixing was caused by a high temperature offset phenomenon. Then, when the heating roller set temperature T2° C. in the ready state was held at 175° C., it was revealed that it was immediately after shifted to the ready state and when the fixing was started at the fixing belt temperature as high as 155° C., a bad fixing was caused by the high temperature offset phenomenon but if the fixing belt temperature reached 135° C., a good fixing property was obtained without causing a bad fixing by the high temperature offset phenomenon. Further, when the heating roller set temperature T2° C. in the ready state was held at 165° C. that was the same as the heating roller set temperature T1° C. in the heating and fixing state, it was revealed that a good fixing was obtained without causing a bad fixing by the high temperature offset phenomenon even if the fixing belt temperature was as high as 155° C.

That is, it was revealed that in order to prevent the high temperature offset phenomenon when the fixing operation was completed and the next fixing operation was started immediately after shifting to the ready state, it was only necessary to gradually raise the heating roller to 185° C. that was the heating roller set temperature in the ready state according to the state of temperature of the fixing belt 33 that was cooled down by radiation of heat without immediately raising it to 185° C. after completing the fixing operation.

Next, the actions will be described. When the power source is turned on, the fixing device 30 starts the warm-up operation, the heater lamp 34 is turned on until the heating roller reaches 185° C., the main motor 54 is turned on, and the fixing belt 33 is rotated in the arrow direction s. When the thermistor 35 detects that the temperature of the heating roller 31 reaches 185° C. after starting the warm-up, a ready mark is lighted on the display 53, the main motor 54 is stopped and the fixing belt 33 is stopped. Thereafter, the ON/OFF of the heater lamp 34 is controlled by the fixing driver 57 and the heating roller 31 is held at 185° C., which is the heating roller set temperature in the ready state. At the same time, the surface temperature of the pressing roller 36 is held at 145° C. by controlling the ON/OFF of the heater lamp 37.

Figure 6:
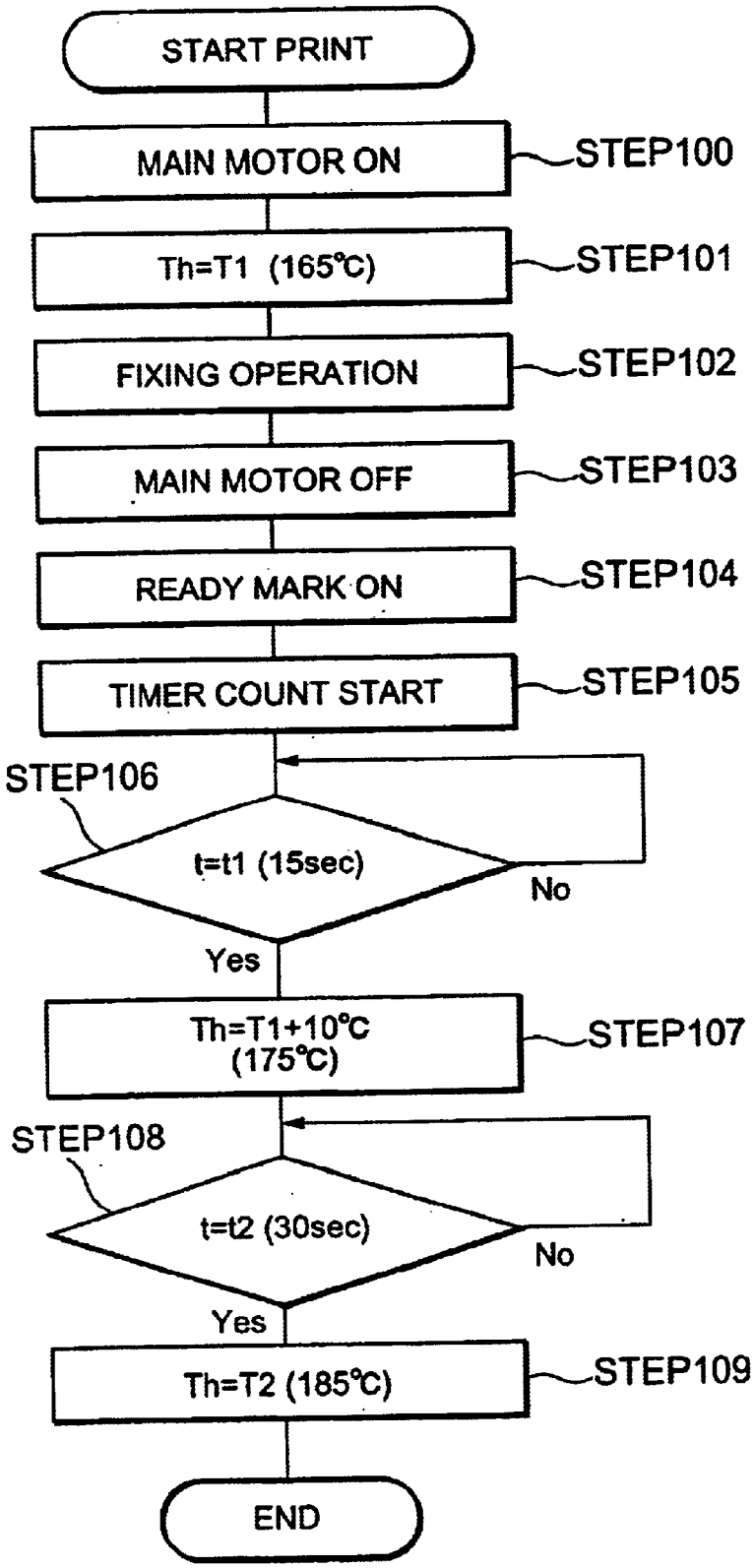
FIG. 6 is a flowchart showing the control of the fixing device in the first embodiment of the present invention.
Figure 7:
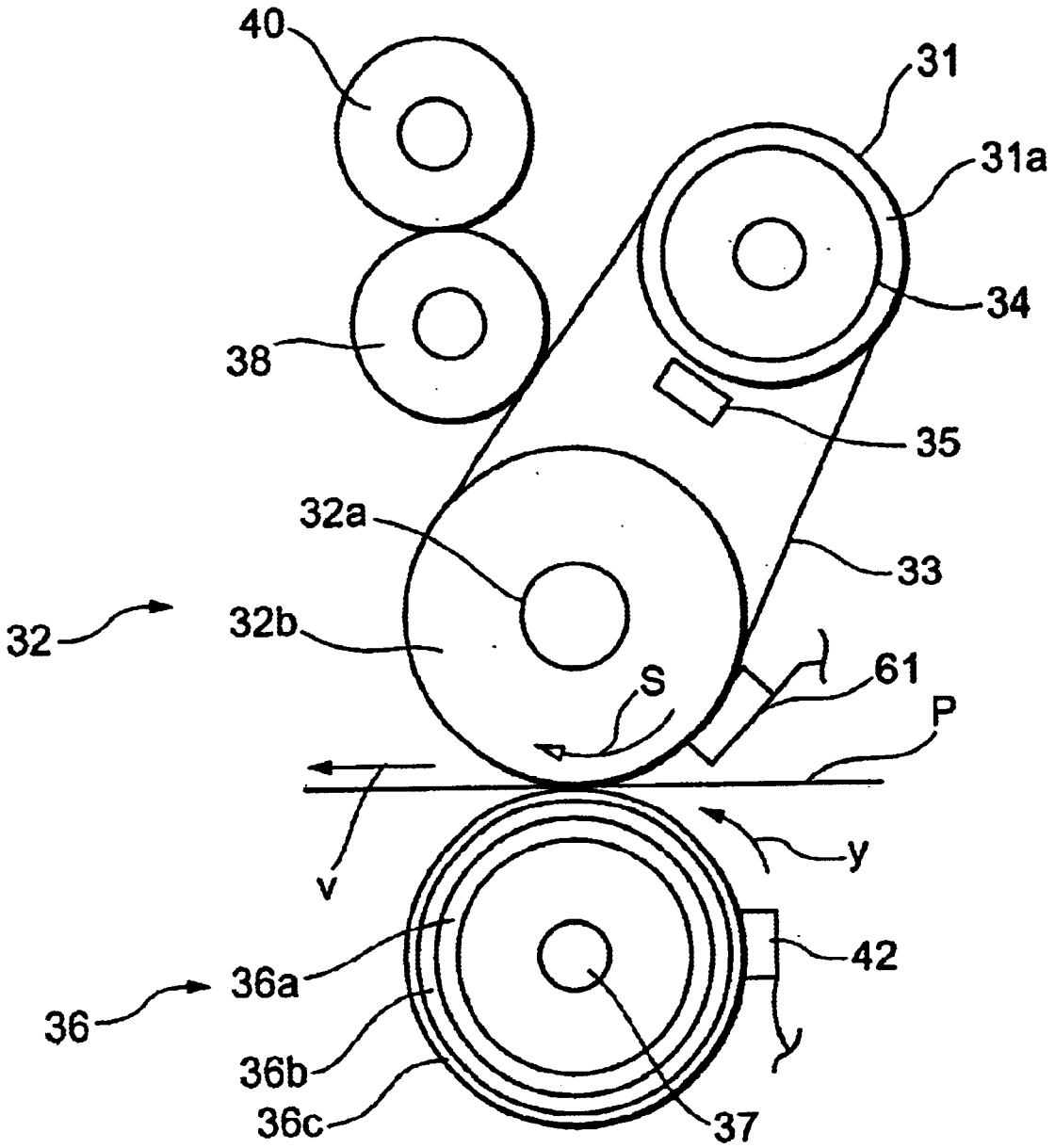
FIG. 7 is a schematic diagram showing essential elements in a second embodiment of the present invention.
Figure 8:
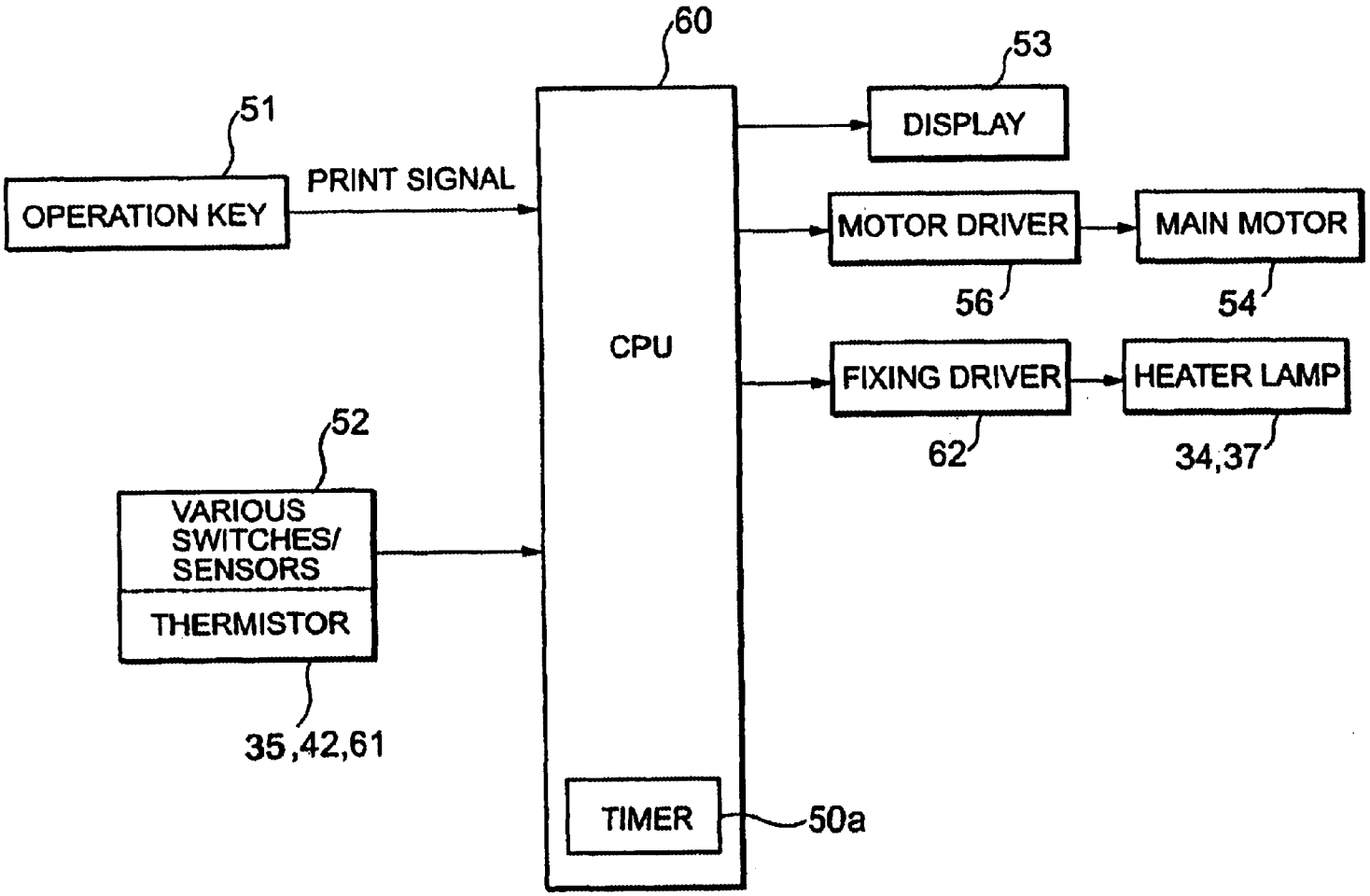
FIG. 8 is a block diagram showing essential elements of a controller in the second embodiment of the present invention.

When a print signal is input through the operation key 51 and the print operation is started in the ready state, as shown in the flowchart in FIG. 6, in the fixing device 30, the main motor 54 is turned on in Step 100, and the fixing roller 32 is rotated in the arrow direction s. Following this rotation of the fixing roller 32, the fixing belt 33 and the heating roller 31 are rotated and further, the pressing roller 36 that is press fitted to the fixing belt 33 is rotated.

Then, in Step 101 as the first step, the ON/OFF of the heater lamp 34 is controlled by the fixing driver 57 and the temperature of the heating roller 31 is lowered to and held at 165° C., which is the heating roller set temperature in the heating and fixing state. During this period, the fixing belt 33 is heated at the contacting area with the heating roller 31, the heated area reaches the nip between the fixing roller 32 and the pressing roller 36 by the rotation of the fixing belt 33 and a toner image on a sheet of paper P is fixed in Step 102.

A toner image on a sheet paper P is formed by an image forming unit 10 according to image data input from a scanner (not illustrated). That is, in the case of a full-color image, taking the yellow station 12Y as an example, following the rotation of the photo-conductive drum 14Y in the arrow direction u, image forming steps are executed in order and first, the drum is uniformly charged by the charger 16Y. Then, this uniformly charged photo-conductive drum 14y is exposed by the exposing device 17Y and a latent image corresponding to an yellow (Y) image data is formed on the photo-conductive drum 14Y. Hereafter, the latent image formed on the photo-conductive drum 14y is developed by the developing device 18Y and the yellow (Y) toner image is formed on the photo-conductive drum 14Y.

Similarly to this, respective color images are formed on the photo-conductive drums 14M, 14C and 14BK in the magenta (M), cyan (C) and black (BK) stations.

On the other hand, synchronized with the formation of respective color toner images on the photo-conductive drums 14Y, 14M, 14C, 14BK, the pick-up roller 26 is driven and a sheet of paper P is supplied from the paper cassette 24. This sheet of paper P is supplied to the transfer and conveyor belt 13 after the leading edge is aligned by the aligning roller 28.

The sheet of paper P sent to the transfer and conveyor belt 13 is conveyed in the arrow direction v accompanied with the running of the transfer and conveyor belt 13 in the state electrostatically adsorbed to the belt 13 by the charge given from the adsorbing roller 43. Then, while the sheet paper P is being conveyed in the arrow direction v, yellow, magenta, cyan and black toner images are transferred on the sheet of paper P at the positions of the transferring rollers 20Y, 20M, 20C and 20BK, and a full-color toner image is formed and conveyed to the fixing device 30. The sheet of paper P with the full-color unfixed toner image transferred passes through the nip formed between the heating roller 31 and the pressing roller 36 of the fixing device 30 in the arrow direction v, is brought in contact with the fixing belt 33, and the toner image on the sheet of paper P is heated, pressed and fixed thereon. Further, after fixing, the sheet of paper P is discharged on the discharged paper tray 42 by the paper discharge roller pair 41.

On the other hand, after separating the sheet of paper P, the transfer and conveyor belt 13 is rotated and driven continuously and adhered toner and paper powder are cleaned by the belt cleaner 46. After this cleaning, the surface potential of the transfer and conveyor belt 13 is reduced to a definite level by the transfer and conveyor belt charge eliminating roller 44. Further, the photo-conductive drums 14Y, 14M, 14C, 14BK are rotated and driven continuously and residual toner and paper power are removed by the cleaners 21Y, 21M, 21C, 21BK. After this cleaning, the surface charge of the photo-conductive drums 14Y, 14M, 14C, 14BK is eliminated by the charge eliminators 22Y, 22M, 22C, 22BK and the next full-color image forming process is waiting. In addition, the fixing belt 33 iss also cleaned by the oil coating roller 38.

Hereafter, when a paper discharge sensor (not illustrated) detects that the trailing edge of the last sheet paper P passed the fixing device 30, the main motor 54 is turned OFF in Step 103, the ready mark on the display 53 is lighted in Step 104 and the fixing device 30 becomes the ready state. That is, Steps 105~107 of the flowchart in FIG. 6 are executed as Step 102. First, the timer is started in Step 105 and proceeds to Step 106. In Step 106, when the timer count t elapses t1 second (15 seconds in this embodiment), the heating roller 31 is raised to and held at 175° C. (the heating roller set temperature 165° C.+10° C.) by controlling the ON/OFF of the heater lamp 34 by the fixing driver 57 in Step 107.

Then, as a third step, when the timer count elapses t2 seconds (30 seconds in this embodiment) after elapsing t1 in Step 108, the heating roller 31 is raised to and held at 185° C., which that is the heating roller set temperature in the ready state by controlling the ON/OFF of the heater lamp 34 by the fixing driver 57 in Step 109, and raising the temperature of the heating roller 31 in two stages. From 165° C. in the heating and fixing state to 185° C. in the ready state, a series of fixing operations is completed. Further, when the next print operation is started after completing the fixing operation of the last sheet paper P, the operation immediately returns to Step 100 and the next fixing operation is executed.

When the fixing operation by the next print operation was executed after completing the fixing by the fixing device 30 and immediately after shifting to the ready state, a bad fixing caused from the high temperature offset was not observed.

According to the first embodiment in the structure as described above, in a fixing device 30 prevented a first copying time from becoming long by making the temperature rise of the fixing belt 33 fast by setting the heating roller 31 in the ready state at a temperature higher than that of the heating roller 31 in the heating and fixing state. When 15 seconds passed after completing the fixing operation, the temperature of the fixing belt 33 drops to lower than the temperature in the fixing state, and the set temperature of the heating roller 31 is raised twice from the 165° C. in the state of fixing operation to 185° C. in the ready state. Accordingly, when the next printing operation is executed immediately after shifting to the ready state after completing the fixing operation, it is also possible to prevent the excessive heating of the fixing belt 33 as well as a bad fixing caused by the high temperature offset phenomenon, and obtain a good fixed image.

Next, the present invention will be explained referring to a second embodiment shown in FIG. 7 through FIG. 10. In this second embodiment, instead of the fixing device 30 which controlled the temperature rise of the heating roller gradually according to a timer count when shifting to the ready state after the fixing operation was completed in the first embodiment, the fixing device 30 controls the temperature rise of the heating roller gradually according to the surface temperature of the fixing belt after the fixing operation is completed and others are the same as those in the first embodiment. So, the same component elements as those explained in the first embodiment will be assigned with the same reference numerals and the detailed explanation thereof will be omitted.

Around the fixing belt 33 wound round the outer surface of the fixing roller 32 in this embodiment, a thermistor 61 that is a first temperature detecting device to detect the surface temperature of the fixing belt 33 is arranged. The thermistor 61 is connected to the input side of the CPU 60, which is a full-color printer controller as well as a temperature controller. A fixing driver 62 that is connected to the output side of the CPU 60 controls the heater lamp 34 according to the temperature detected result from the thermistor 35, 61 and the heater lamp 37 according to the temperature detection result.

Figure 9:
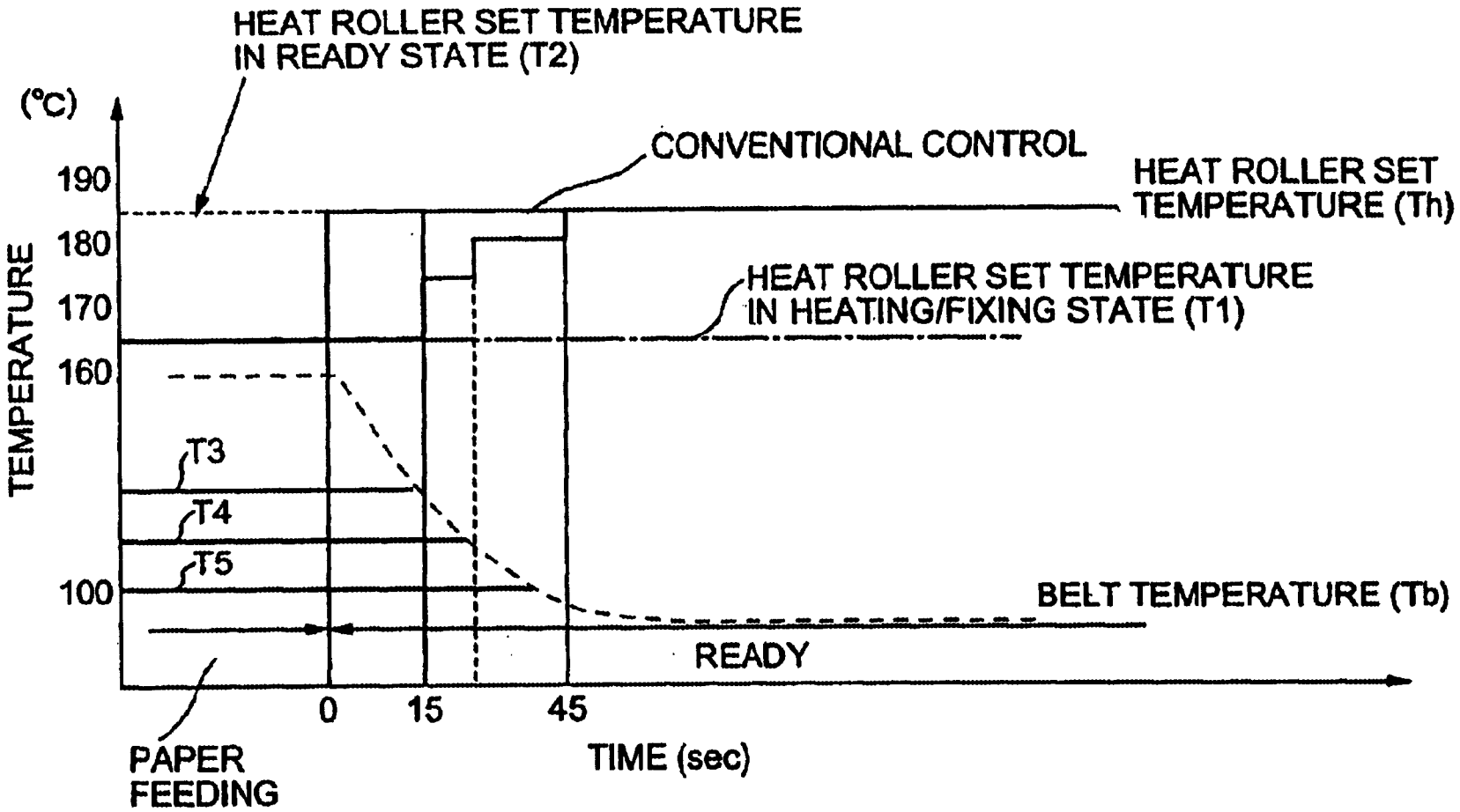
FIG. 9 is a graph showing the temperature control of the heating roller in the second embodiment of the present invention.

In other words, the fixing driver 62 controls the surface temperature (Th) of the heating roller 31 as shown in FIG. 9 by controlling the ON/OFF of the heater lamp 34. In the ready state wherein the fixing belt 33 is stopped by the stop of the main motor 54, the surface temperature (Th) of the heating roller 31 is held at the heating roller set temperature T2° C. (185° C. in this embodiment), which that is a second set temperature, and during the printing by a full-color printer and the heating and fixing of the fixing device 30, the surface temperature (Th) of the heating roller 31 is held at the heating roller set temperature in the heating and fixing state T1° C. (165° C. in this embodiment), which that is a first set temperature lower than the second set temperature. During the printing by a full-color printer and the heating and fixing of the fixing device 30, the surface temperature (Th) of the heating roller 31 is held at the heating roller set temperature in the heating and fixing state T1° C. (165° C. in this embodiment), which is lower than the second set temperature.

After the print was completed, when the thermistor 61 detected that the temperature Tb of the fixing belt 33 dropped to below T3° C. (130° C. in this embodiment) as a result of radiation of heat, the surface temperature (Th) of the heating roller 31 is set at the heating roller set temperature in the heating and fixing state T1+10° C. (175° C. in this embodiment). Then, when the thermistor 61 detected that the temperature Tb of the fixing belt 33 further dropped to below T4° C. (115° C. in this embodiment), set the surface temperature (Th) of the heating roller 31 at the heating roller set temperature in the heating and fixing state T1+15° C. (180° C. in this embodiment). When the thermistor 61 detects that the temperature Tb of the fixing belt 33 further dropped to below T5° C. (105° C. in this embodiment), set the surface temperature (Th) of the heating roller is set so that it is gradually raised to the heating roller set temperature T2° C. in the ready state (185° C. in this embodiment).

Figure 10:
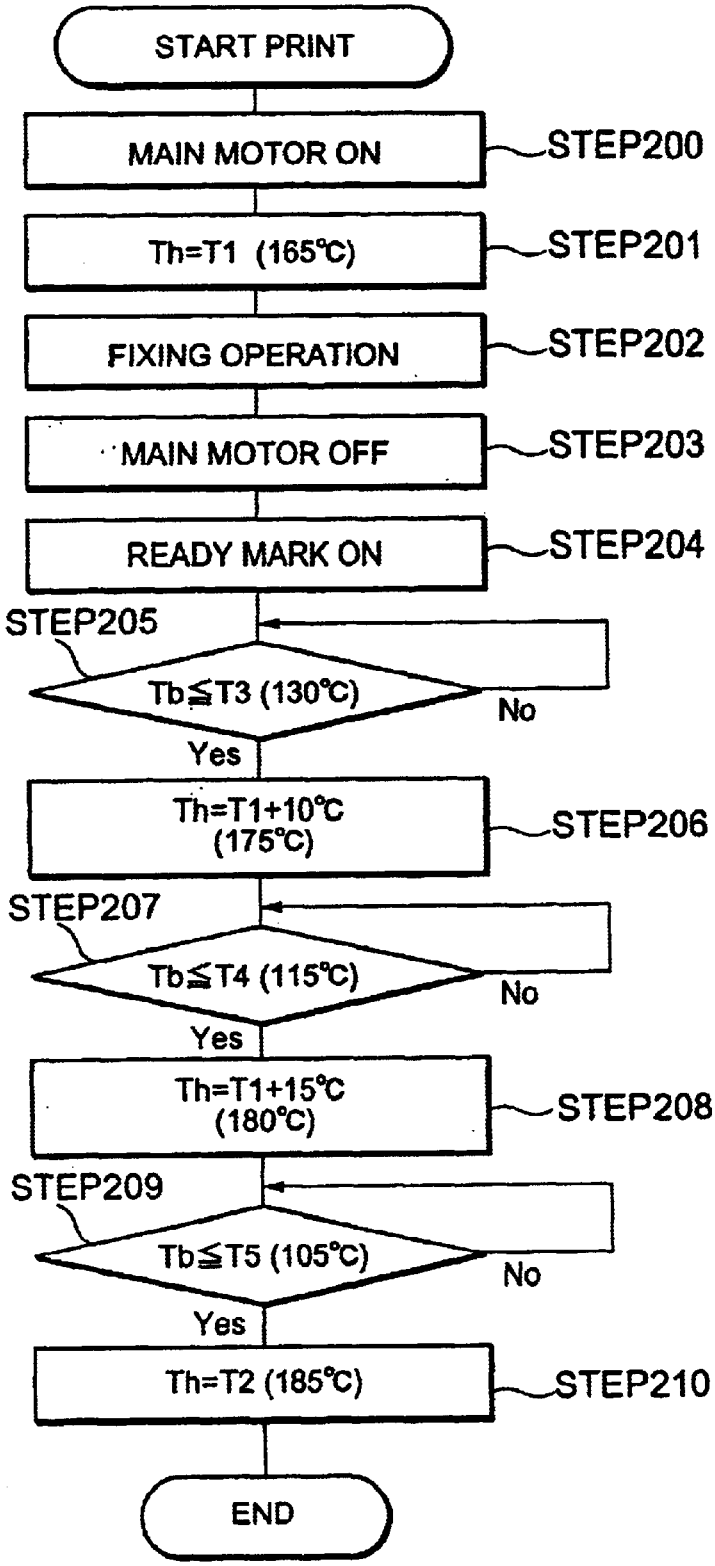
FIG. 10 is a flowchart showing the control of the fixing device in the second embodiment of the present invention.

Next, the actions of the fixing device after starting the print will be described referring to the flowchart shown in FIG. 10. When a print signal is input through the operation key 51 and the print is started, the main motor 54 is turned ON in Step 200, the fixing roller 32, the fixing belt 33 that is operated following the fixing roller, and the heating roller 31 are rotated in the arrow direction s, and the pressing roller 36 is rotated in the arrow direction y. Further, as a first step, the surface temperature of the heating roller 31 is reduced to and held at 165C., which is the heating roller set temperature in the heating and fixing state by controlling the ON/OFF of the heater lamp 34 by the fixing driver 62 in Step 201, and the fixing operation is executed in Step 202.

Hereafter, at the completion of the fixing operation when the end of the sheet of paper P is detected, the main motor 54 is turned OFF in Step 203, the ready mark is lighted on the display 53 and the fixing device 30 is shifted to the ready state in Step 204. That is, as Step 2, Steps 205~208 of the flowchart shown in FIG. 10 are executed. First, proceeding to Step 205, when the thermistor 61 detected that the fixing belt temperature Tb dropped to below T3° C. (130° C. in this embodiment), the temperature of the heating roller 31 is raised to and held at 175° C. (the heating roller set temperature 165° C.+10° C. in the heating and fixing state) by controlling the ON/OFF of the heater lamp 34 by the fixing driver 62 in Step 206. Then, when the thermistor 61 detected that the fixing belt temperature Tb dropped to below T4° C. (115° C. in this embodiment) in Step 207, the temperature of the heating roller 31 is raised to and held at 180° C. (the heating roller set temperature in the heating and fixing state 165° C.+15° C.) by controlling the ON/OFF of the heater lamp of the fixing driver 62 in Step 208. Then, as a third step, when the thermistor 61 detected that the fixing belt temperature Tb dropped to below T5° C. (105° C. in this embodiment) in Step 209, the temperature of the heating roller 31 is raised to and held at 185° C., which is the heating roller set temperature in the ready state by controlling the ON/OFF of the heater lamp 34 by the fixing driver 62 in Step 210, and the temperature of the heating roller 31 is raised in 3 steps from 165° C. in the heating and fixing state to 185° C. in the ready state, and a series of fixing operation is completed. Further, when the next print operation was started after the fixing operation of the last sheet of paper P was completed, immediately returning to Step 200, the next fixing operation is executed.

When the fixing operation by the next print operation was executed immediately after shifting to the ready state after completing the fixing by the fixing device 30, the bad fixing for the high temperature offset was avoided not recognized.

According to the second embodiment that is in the construction described above, the fixing device 30 prevented the first copying time from becoming long by making the rise of the fixing belt fast by setting the temperature of the heating roller 31 in the ready state higher than the temperature of the heating roller 31 in the heating and fixing state. The set temperature of the heating roller 31 is shifted from 165° C. in the state of fixing operation to 185° C. in the ready state in 3 steps according to the detected result of the temperature of the fixing belt 33 after detecting the temperature drop of the fixing belt 33 by the thermistor 61 and after completing the fixing operation. Accordingly, like the first embodiment described above, when the next print operation is executed immediately after shifting to the ready state and after completing the fixing operation, it is also possible to prevent the fixing belt 33 from being excessively heated, prevent a bad fixing for the high temperature offset phenomenon, and obtain a good fixed image.

Further, in this embodiment, as the fluctuation in temperature of the fixing belt 33 is directly detected by the thermistor 61 and the temperature of the heating roller 31 is controlled according to this detection result, it becomes possible to control temperatures accurately without being affected by ambient circumferential changes, etc., surely prevent generation of the high temperature offset phenomenon and further improve the quality of fixed images.

Further, the present invention is not restricted to the embodiments described above but can be modified variously within the scope of the present invention and, for example, the set temperature of the heating device is not restricted is optional according to characteristics of a belt device within the range wherein the set temperature in the ready state is higher than that in the fixing operation and the first copying time can be prevented from becoming long. Further, the number of changes to shift a set temperature of the heating device to the ready state after completing the fixing operation is optional within a range not generating the high temperature offset phenomenon, and after waiting the first heating device from dropping to a prescribed temperature, the temperature can be shifted to the set temperature in the ready state in one time or in multiple steps. Further, plural sources of heat for the heating device can be provided. In addition, the structure, etc. of an image forming apparatus in which the fixing device of the present invention is installed are not restricted.

According to the present invention as described above in detail, in a fixing device to set a set temperature of the heating device to heat the belt device in the ready state higher than that in the fixing operation, when a temperature of a second heating device is raised from a low temperature in the state of fixing operation to a high temperature in the ready state after waiting that for a temperature of a first heating device drops after completing the fixing operation, it becomes possible to prevent the generation of the high temperature offset when the next fixing operation is started immediately after shifting to the ready state after and completing the fixing operation without harming the reduction of the first copying time and obtain a good fixed image without causing a bad fixing resulting from the high temperature offset phenomenon.

What is claimed is:

1. A fixing device comprising:

a fixing belt that is brought in contact with a recording medium to heat and fix a developer image formed on the recording medium;

plural supporting rollers to support the fixing belt rotatably;

a pressing roller that is arranged opposing to the supporting rollers via the fixing belt to clamp and convey the recording medium jointly with the fixing belt;

a heating roller to heat the fixing belt by keeping a first set temperature in a heating and fixing state of the developer image by the fixing belt and by keeping a second set temperature higher than the first set temperature in a ready state; and a temperature controller that raises a temperature of the heating roller from the first set temperature to the second set temperature after the temperature of the fixing belt drops to a prescribed temperature lower than the temperature in the heating and fixing state when shifting to the ready state after the heating and fixing state is completed.

2. The fixing device according to claim 1, further comprising:

a first temperature detecting device to detect for detecting a temperature of the fixing belt;

wherein the temperature controller raises a temperature of the heating roller to the second set temperature from the first set temperature according to the detection result of the first temperature detecting device.

3. The fixing device according to claim 1, further comprising:

a second temperature detecting device to detect a temperature of the heating roller;

wherein the temperature controller raises a temperature of the heating roller to the second set temperature from the first set temperature according to the detection result of the second temperature detecting device.

4. The fixing device according to claim 1, wherein the temperature controller raises a temperature of the heating roller to the second set temperature from the first set temperature after elapsing a prescribed time after the heating and fixing state is completed.

5. The fixing device according to claim 1, wherein the temperature controller raises a temperature of the heating roller to the second set temperature from the first set temperature.

6. The fixing device according to claim 5, further comprising:

a first temperature detecting device to detect a temperature of the fixing belt;

wherein the temperature controller raises a temperature of the heating roller gradually to the second set temperature from the first set temperature according to the detection result of the first temperature detecting device.

7. The fixing device according to claim 5, further comprising:

a second temperature detecting device to detect the temperature of the heating roller;

wherein the temperature controller raises a temperature of the heating roller gradually to the second set temperature from the first set temperature according to the detection result of the second temperature detecting device.

8. The fixing device according to claim 5, wherein the temperature controller raises the temperature of the heating roller gradually to the second set temperature from the first set temperature after elapsing a prescribed time after completing the heating and fixing.

9. A temperature control method in a fixing device including a fixing belt, a heating roller to heat the fixing belt and a pressing roller arranged opposing to the fixing belt to clamp and convey a recording medium on which a developer image is formed, comprising the steps of:

keeping the fixing belt at a first set temperature while the developer image is being heated and fixed;

raising a temperature of the heating roller to a second set temperature from the first set temperature when a temperature of the fixing belt drops to a prescribed temperature lower than that in the heating and fixing after completing the heating and pressure fixing of the developer image; and keeping the fixing belt at the second set temperature in a ready state.

10. The temperature control method according to claim 9, wherein the temperature raising step is for raising the temperature of the heating roller to the second set temperature from the first set temperature when a prescribed time elapsed after completing the heating and pressure fixing.

11. The temperature control method according to claim 9, wherein the temperature raising step is for raising the temperature of the heating roller gradually to the second set temperature from the first set temperature.

12. The temperature control method according to claim 11, wherein the temperature raising step is for raising the temperature of the heating roller gradually to the second set temperature from the first set temperature when a prescribed time elapsed after completing the heating and pressure fixing.

* * * * *